United States Patent [19]

Long

[11] Patent Number: 4,702,943

[45] Date of Patent: Oct. 27, 1987

[54] PATTERN FORMING SATURATOR AND METHOD

[75] Inventor: Eliot R. Long, Arlington Heights, Ill.

[73] Assignee: Miply Equipment, Inc., South Bend, Ind.

[21] Appl. No.: 883,550

[22] Filed: Jul. 9, 1986

[51] Int. Cl.[4] ..... B05D 5/00; B05D 1/18; B05C 3/132; B05C 3/20

[52] U.S. Cl. ..... 427/282; 68/158; 118/406; 118/419; 118/429; 427/434.2; 427/434.5

[58] Field of Search ..... 118/406, 419, 429; 427/282, 434.2, 434.5; 68/158

[56] References Cited

U.S. PATENT DOCUMENTS

| | | | |
|---|---|---|---|
| 1,546,834 | 7/1925 | Hanington | 101/129 |
| 2,056,274 | 10/1936 | Holdsworth | 264/167 |
| 2,711,032 | 6/1955 | Penley | 34/122 |
| 2,904,448 | 9/1959 | Sorg | 427/208.2 |
| 3,088,859 | 5/1963 | Smith | 156/26 |
| 3,436,245 | 4/1969 | Grundman | 428/89 |
| 3,772,054 | 11/1973 | Anselrode | 427/282 |
| 4,280,343 | 7/1981 | Fleissner | 68/158 |
| 4,588,616 | 5/1986 | Menser | 427/430.1 |

*Primary Examiner*—Evan K. Lawrence

*Attorney, Agent, or Firm*—Willian Brinks Olds Hofer Gilson & Lione Ltd.

[57] ABSTRACT

A saturator of the type comprising a chamber situated between a chamber defining element and a mandrel, in which a web is moved between the chamber defining element and the mandrel to impregnate the web with a saturant contained in the chamber includes a stencil having at least one impermeable region shaped to cover less than the entire web. The stencil is passed through the chamber at the same speed as the web with the stencil juxtaposed against the web such that portions of the web aligned with the at least one impermeable region are not impregnated with the saturant, while other exposed portions of the web are impregnated with the saturant.

61 Claims, 13 Drawing Figures

PATTERN FORMING SATURATOR AND METHOD

BACKGROUND OF THE INVENTION

The present invention relates to saturators for impregnating a substrate with a saturant, and in particular to an improved saturator and saturating method for impregnating only selected portions of a substrate with a saturant.

Saturators have been used for some time to impregnate substrates such as webs of paper with varying amounts of saturants. By properly selecting the amount and type of saturant to provide the desired characteristics to the substrate, saturators can be used to enhance the physical characteristics, and therefore the value, of the substrate.

For example, one valuable saturant is sodium silicate. When high levels of sodium silicate are added to a paper web, the paper can be made fire resistant and can be given much improved structural strength. However, such highly impregnated paper can be difficult to fold or crease in conventional paper processing machines. It therefore would be advantageous to impregnate a paper web with sodium silicate only at selected portions of the web. For example, if a paper web were to be used to form a box in which stacking strength were an important consideration, it would often be advantageous to apply sodium silicate only to the sidewalls of the box, and not to the top and bottom panels, which must be folded in use.

As another example, containers such as beer cases are subjected to unusual wear patterns. The tops and bottoms of the cans within the case act as cookie cutters during transportation and can severely damage either the printing on or the actual structure of the top and bottom panels of the case. If sodium silicate were applied to the top and bottom panels, this cookie cutter effect could be resisted effectively. In this example, however, there is no need to apply sodium silicate to the sidewalls, and it would save the cost of materials if the saturant could be placed on only the top and bottom panels and not the sidewalls of the case.

In spite of the important advantages that selective saturation would provide in the examples described above, the applicant is unaware of any saturator that performs this function. The saturator described in Menser U.S. Pat. No. 4,588,616 is an extremely effective device which can be used to saturate substrates with a range of saturants at both relatively low and extremely high add-on weights. Similarly, U.S. Pat. No. 2,711,032 describes another type of saturator used in the past. However, neither of these saturators is provided with means for selectively impregnating only portions of the web with the saturant.

In the past, stencils have been used with a variety of surface applicators for liquids of various types. However, such stencils have not, to the knowledge of the applicant, been used with saturators. Instead, stencils have typically been used with applcators which apply liquid to the surface of a web without substantial impregnation. Examples of such applicators are spray devices (Smith U.S. Pat. No. 3,088,859); extruders (Sorg U.S. Pat. No. 2,904,448); roller applicators (Holdsworth U.S. Pat. No. 2,056,274); and spreaders (Hannington U.S. Pat. No. 1,546,834). Such applicators differ significantly from saturators in that they apply a liquid to the surface of the substrate without specific pressure to force the applied liquid into the interstices of the substrate and therefore do not provide deep impregnation as does a saturator.

SUMMARY OF THE INVENTION

The present invention is directed to an improved pattern-forming saturator and a method for saturating only selected portions of a web.

According to the apparatus of this invention, a saturator of the type comprising means for defining a chamber for containing a pressurized saturant therein, and means for moving a web through the chamber to bring a first side of the web into contact with the pressurized saturant to cause the saturant to impregnate the web, is provided with a stencil having at least one impermeable region shaped to cover less than the entire web. Means are provided for passing the stencil through the chamber at the same speed as the web with the stencil juxtaposed against the first side of the web, such that portions of the web aligned with the at least one impermeable region are not impregnated with the saturant, while other, exposed portions of the web are impregnated with the saturant.

According to the method of this invention, a saturant is selectively applied only to a patterned portion of a web with a saturator of the type comprising means for defining a chamber for containing a pressurized saturant therein, and means for moving the web through the chamber to bring a first side of the web into contact with the pressurized saturant to cause the saturant to impregnate the web. The method of this invention comprises the steps of (1) providing a stencil having at least one impermeable region shaped to cover less than the entire web, and (2) passing the stencil through the chamber at the same speed as the web with the stencil juxtaposed against the first side of the web, such that the portions of the web aligned with the at least one impermeable region are not impregnated with the saturant, and other, exposed portions of the web are impregnated with the saturant.

As described in detail below, the present invention provides important advantages in that it allows only selected patterned portions of a web to be impregnated with the saturant. By applying the saturant only where it is needed on the web, the cost of saturant is reduced, and the end product can actually be improved. For example, impregnation of the web can be avoided in regions where the web will be creased or folded, such that the saturant does not interfere with such subsequent processing operations. As another example, saturant can be kept out of contact with patterned portions of the web which will subsequently be printed in the event a saturant is used with detracts from the clarity or color trueness of the printing operation.

The invention itself, together with further objects and attendant advantages, will best be understood by reference to the following detailed description, taken in conjunction with the accompanying drawings.

DETAILED DESCRIPTION OF THE PREFERRED EMBODIMENTS

Figure 1:
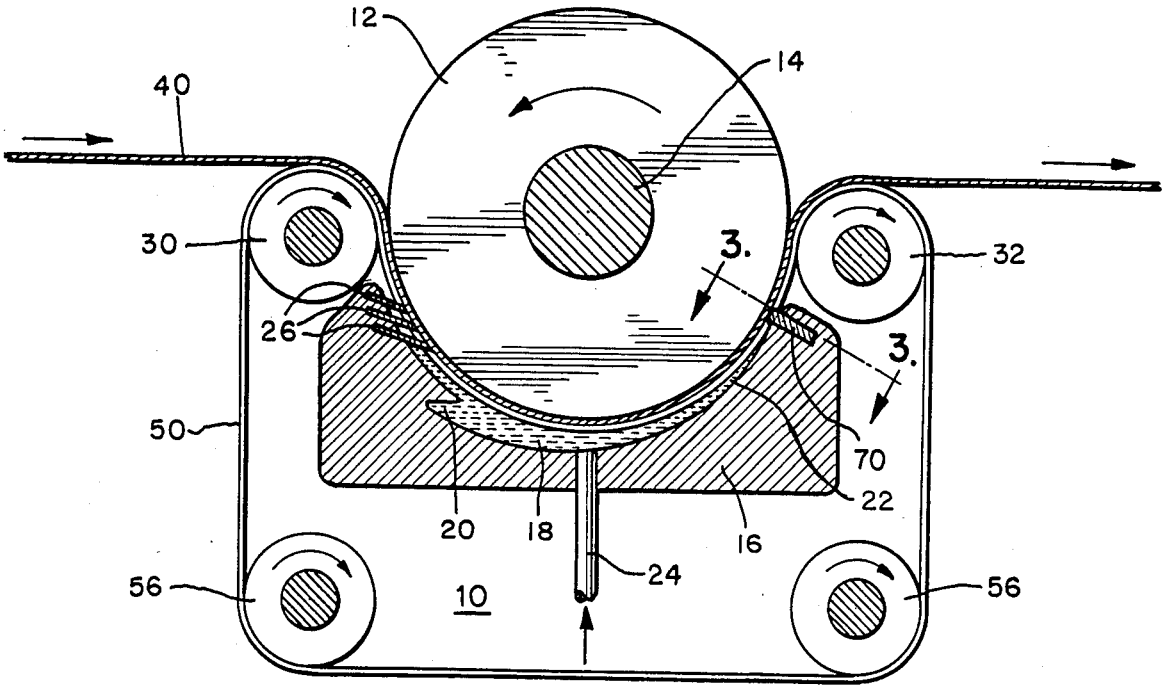
FIG. 1 is a cross-sectional view through a pattern-forming saturator which incorporates a first presently preferred embodiment of this invention.

Turning now to the drawings, FIG. 1 shows a cross sectional view of a pattern-forming saturator 10 which incorporates a first preferred embodiment of this invention. This saturator 10 includes a mandrel 12 which is mounted for powered rotation about an axis defined by a shaft 14. Typically, the mandrel 12 is formed of a steel shell having a length at least as great as the widest web to be processed. The mandrel 12 is mounted for rotation adjacent to a chamber defining element 16 which extends along the length of the mandrel 12. This chamber defining element 16 defines a chamber 18 between the element 16 and the mandrel 12. This chamber 18 is characterized by an entrance region 20 and an exit region 22. The chamber 18 is deeper in the entrance region 20 than in the exit region 22, and preferably the chamber 18 tapers in depth in a gradual and progressive manner.

A supply port 24 supplies a liquid saturant, such as an aqueous sodium silicate solution, to the chamber 18. If desired, the saturant can be supplied to the chamber 18 under pressure via the supply port 24, or alternately, the self-pressurizing features of the saturator 10 described below can be used to create the desired pressure of saturant within the chamber 18. A plurality of spring seals 26 formed of a suitable spring steel are mounted to the chamber defining element 16 adjacent to the entrance region 20 to impede the flow of saturant out of the chamber 18. An entrance roll 30 and an exit roll 32 are mounted for rotation adjacent to respective sides of the chamber defining element 16.

The features of the saturator 10 described above are substantially identical to those described in Menser U.S. Pat. No. 4,588,616. This patent is hereby incorporated by reference for its detailed teaching of the structure of the saturator 10, and in particular for its teaching of the geometry of the converging chamber 18. As explained in detail in the Menser patent, a web 40 is passed between the mandrel 12 and the chamber defining element 16, such that the web 40 is moved through the chamber 18 from the entrance region 20 to the exit region 22, carried by the rotation of the mandrel 12. Movement of the web 40 through the converging chamber 18 pressurizes the saturant within the chamber 18, thereby forcing the saturant to impregnate voids or pores in the web 40. After the web 40 has been impregnated with the saturant, it leaves the converging chamber 18 via the exit roll 32 and typically passes to an oven (not shown) where volatile components of the saturant are removed. As one example of a suitable saturant, aqueous solutions of sodium silicate as described in the Menser patent can be used.

According to this invention, a stencil 50 is provided to prevent patterned portions of the web 40 from coming into contact with the saturant in the chamber 18. This stencil 50 includes both impermeable regions 52 and permeable regions 54. As shown in FIG. 1, the stencil 50 preferably moves in a closed loop about the entrance roll 30, the exit roll 32, and idler rolls 56, such that the stencil 50 is in intimate contact with the side of the web 40 facing the chamber defining element 16. In the permeable regions 54 of the stencil 50, the saturant comes into contact with the web 40 and the web 40 is impregnated with saturant in the conventional manner. In the impermeable regions 52 of the stencil 50 the saturant is prevented from coming into contact with the web 40.

The stencil 50 preferably moves at the same linear speed as the web 40, such that there is no relative movement between the web 40 and the stencil 50. In this embodiment, this desired result is obtained in that the web 40 frictionally engages and drives the stencil 50. Of course, in alternate embodiments it may be preferable to provide an active drive system for the stencil 50 to synchronize the linear speed of the stencil 50 with the web 40.

Figure 2A:
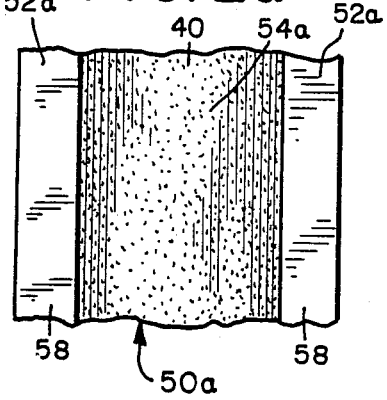
FIGS. 2*a*, 2*b* and 2*c* are partial plan views of alternative stencils suitable for use in the saturator of FIG. 1.
Figure 2B:
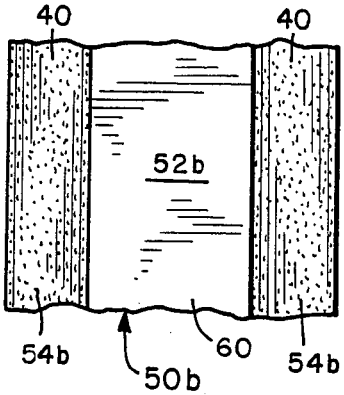
Figure 2C:
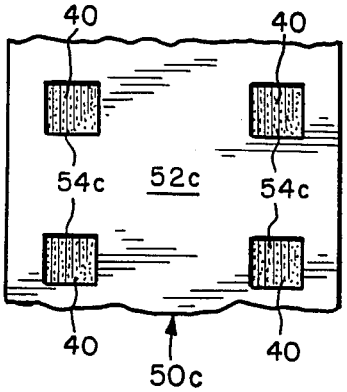

FIGS. 2*a*, 2*b* and 2*c* provide partial plan views of three exemplary stencils 50*a*, 50*b* and 50*c* that may be used with the pattern-forming saturator 10 of FIG. 1. The first example of FIG. 2*a* includes two lateral bands 58, each having a substantially constant width, and each positioned to protect a respective lateral portion of the web 40. Thus, the impermeable regions 52*a* of the stencil 50*a* cover the two lateral edges of the web 40, and the permeable region 54*a* allows the central region of the web 40 to be impregnated with the saturant.

FIG. 2*b* shows an alternative stencil 50*b* which includes one central band 60 having a generally uniform width. This central band 60 is positioned to insure that the impermeable region 52*b* is centered on the web 40 to prevent the central portion of the web 40 from being impregnated with the saturant. The lateral edges of the web 40 are aligned with the permeable regions 54*b* of the stencil 50*b*, and are impregnated with saturant as the web 40 moves through the chamber 18.

FIG. 2*c* shows a third stencil 50*c* which comprises a band that extends over the full width of the web 40. This band defines discreet permeable regions 54*c*, each completely surrounded by the band which forms the impermeable region 52*c*. The stencil 50*c* insures that the saturator 10 impregnates the web with the saturant only in isolated regions aligned with the discrete permeable regions 54*c*.

Figure 3:
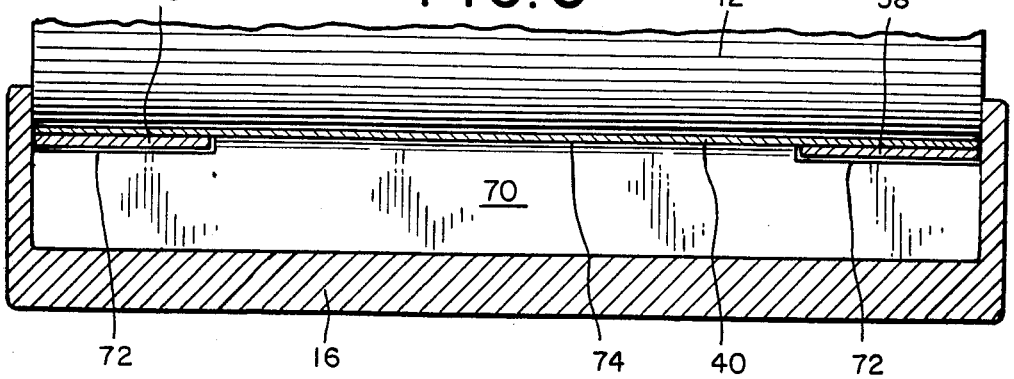
FIG. 3 is a sectional view taken along line 3—3 of FIG. 1.

The saturator 10 provides high saturant pressures in the exit region 22. In order to reduce the leakage of saturant out the exit region 22, the saturator 10 includes an exit seal 70 which is best shown in FIG. 3. In FIG. 3 the stencil 50*a* of FIG. 2*a* is shown for illustrative purposes, including the two lateral bands 58. The exit seal 70 defines recesses 72 positioned to receive the lateral bands 58. These recesses 72 are separated by a raised area 74. The depth of each of the recesses 72 is substantially equal to the thickness of the lateral bands 58. The notched profile of the exit seal 70 defined by the recesses 72 and the raised area 74 seals the exit region 22 to minimize leakage of saturant past the exit seal 70.

In use, the web 40 is passed through the chamber 18 between the stencil 50 and the mandrel 12 such that regions of the web 40 aligned with the impermeable regions 52 of the stencil 50 are protected from contact with the saturant in the chamber 18, while regions of the web 40 aligned with the permeable regions 54 of the stencil 50 are impregnated with the saturant in the conventional manner. In this way, the saturant is applied only to the desired portions of the web 40, thereby providing important advantages in terms of both utility and economy. Utility is improved in that the saturant can be kept out of contact with undesired regions of the web, as for example regions of the web that are to be printed or otherwise processed in a manner incompatible with the saturant. Economy is improved in that by applying the saturant only to the desired portions of the web 40, the usage and therefore cost of the saturant needed to process a particular web 40 are reduced.

Figure 4:
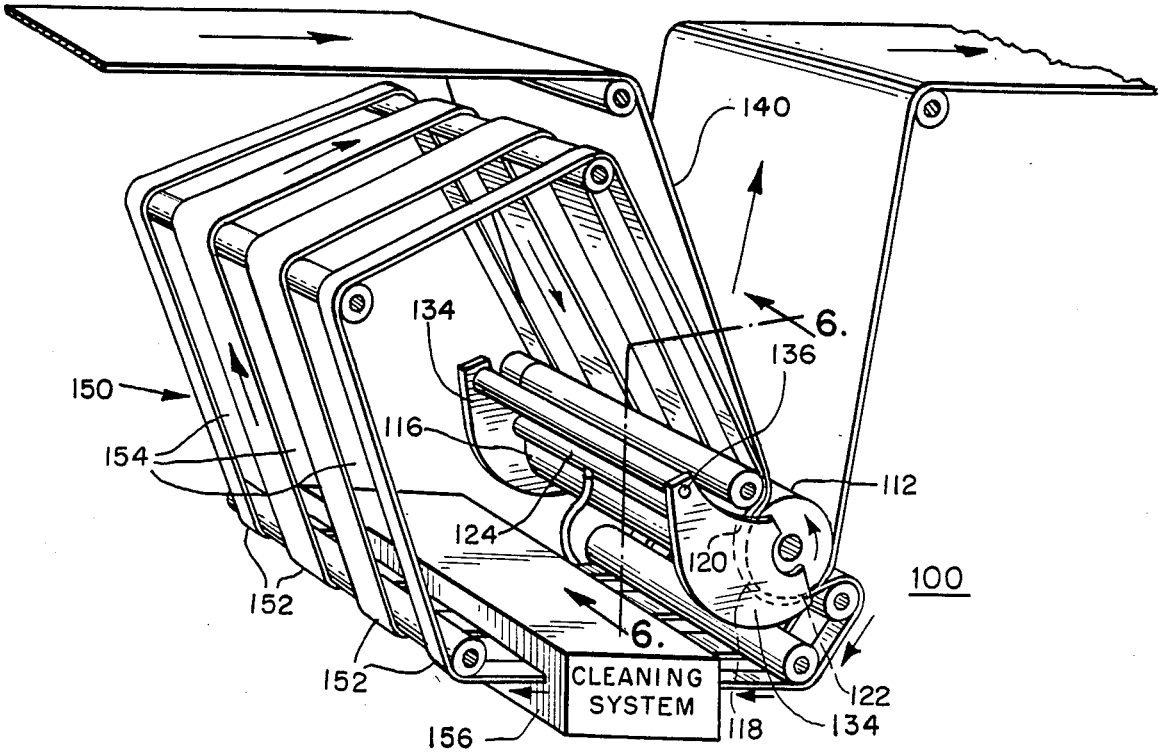
FIG. 4 is a perspective view of a saturator which incorporates a second preferred embodiment of this invention.
Figure 5:
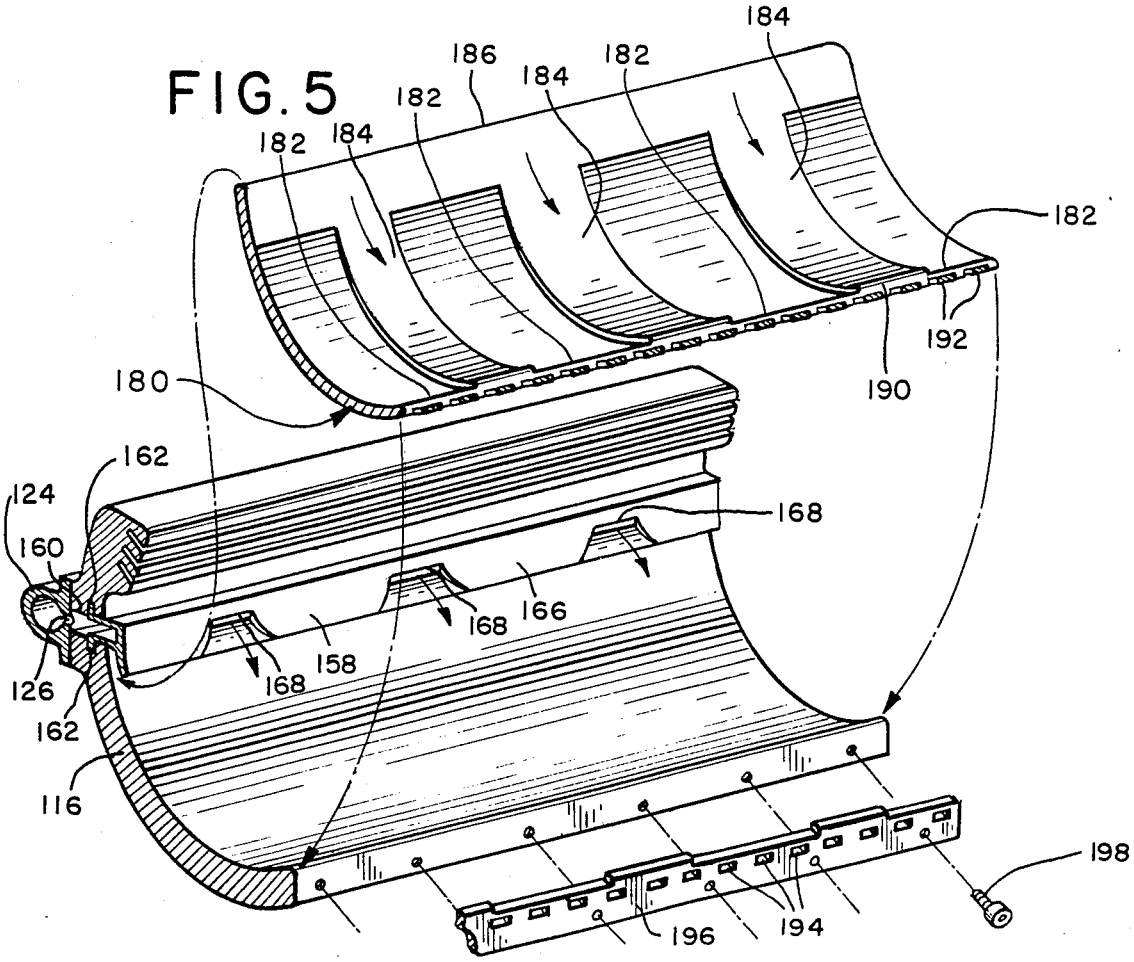
FIG. 5 is an exploded perspective view of components of the saturator of FIG. 4.
Figure 6:
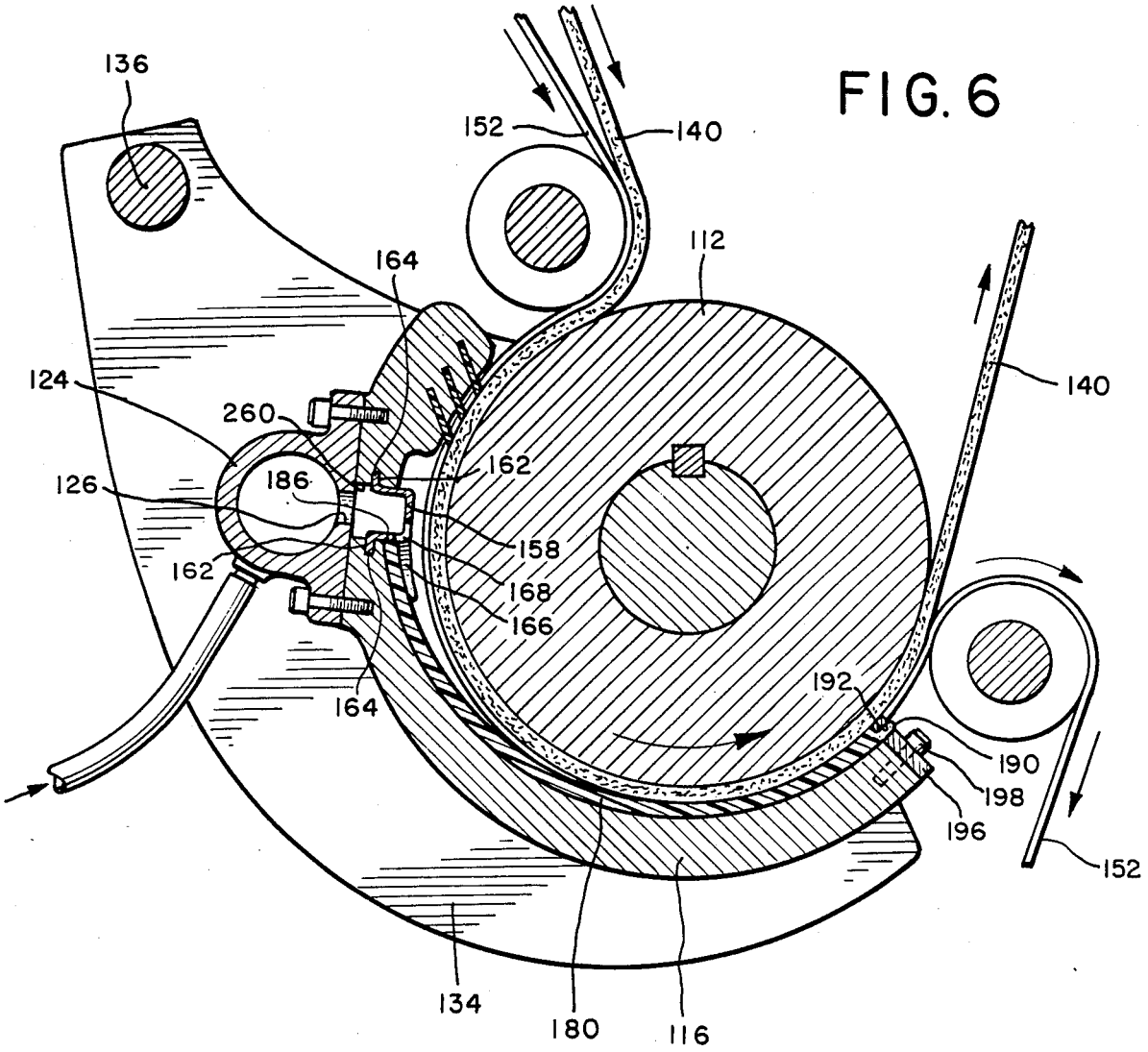
FIG. 6 is a sectional view taken along line 6—6 of FIG. 5.

FIGS. 4–6 relate to a second preferred embodiment 100 of this invention. This embodiment is similar to the first preferred embodiment 10 in that it includes a saturator which includes a rotatable mandrel 112 and a stationary chamber defining element 116. A converging chamber 118 similar to the chamber 18 of the first preferred embodiment is defined between the element 116 and the mandrel 112. This converging chamber 118 defines a relatively deep entrance region 120 and a relatively shallow exit region 122, as described above. Saturant is supplied to the converging chamber 118 through a manifold 124. In alternate embodiments, the saturant can be supplied via the manifold 124 under a wide range of pressures, depending upon the desired degree of saturation and other parameters of the saturation process.

The chamber defining element 116 is mounted on a frame 134 which is, in turn, pivotably mounted for rotation about a pivot axis 136. This mounting arrangement for the element 116 provides a number of important advantages. First, the frame 134 can readily be pivoted away from the mandrel 112. This simplifies cleaning operations and it allows the element 116 to be moved briefly away from the mandrel 112 when necessary to pass a splice on the web 140. Furthermore, this arrangement allows the depth of the converging chamber 118 at the entrance and exit regions 120, 122 to be adjusted substantially independently of one another. By moving the pivot axis 136 toward and away from the mandrel 112, the depth of the entrance region 120 can be precisely adjusted without substantially altering the depth of the chamber 118 at the exit region 122. Similarly, by providing a precisely adjustable stop surface near the exit region 122, the frame 134 can be positioned so as to obtain the desired depth at the exit region 122 without significantly altering the depth at the entrance region 120.

In this embodiment, the web 140 is moved through the converging chamber 118 by rotation of the mandrel 112. A stencil 150 is brought into contact with the surface of the web 140 adjacent to the saturant in the converging chamber 118, and friction between the stencil 150 and the web 140 insures that the stencil 150 moves at the same linear speed as the web 140, without slippage between the stencil 150 and the web 140. If desired, an auxiliary drive system can be provided for the stencil 150 to reduce drag on the web 140.

The stencil 150 of this embodiment includes a number of parallel bands spaced across the length of the mandrel 112. The bands themselves form impermeable regions 152 which prevent saturant from reaching the web 140. The regions between the bands act as permeable regions 154 which allow the saturant to reach and impregnate the web 140. FIG. 4 shows a stencil cleaning system 156 which removes saturant from the stencil 150. A variety of approaches can be used in the system 156 to clean the stencil, such as chemical baths, mechanical brushes, scrapers, and the like.

As best shown in FIGS. 5 and 6, in this embodiment an insert 180 is mounted to the element 116 such that it is the insert 180 that defines the interior wall of the converging chamber 118. This insert 180 is provided with a plurality of spaced parallel grooves 182, each sized to receive a respective one of the bands of the stencil 150. The grooves 182 are separated by raised areas 184. As shown in FIG. 5, the grooves 182 increase in depth as they approach the trailing edge 190 of the insert 180, and at the trailing edge 190 the grooves have a depth equal to the thickness of the bands such that the raised areas 184 directly contact the web 140.

The insert 180 can be formed of any suitable material and it is anticipated that a range of plastics and metals will be found suitable. In this embodiment, the converging chamber 118 is shaped much like the converging chamber 18 shown in FIG. 1, and the leading edge 186 of the insert 180 is positioned to abut a retainer 158 mounted to the element 116 near the entrance region 120.

The preferred arrangement for mounting the insert 180 in place is best shown in FIGS. 5 and 6. The element 116 defines a channel 160 which extends parallel to the mandrel 112. This channel 160 defines spaced parallel slots 162 which extend along the length of the channel 160, and the channel 160 is connected to the manifold 124 through a plurality of spaced ports 126. The retainer 158 defines flanges 164 sized to fit within the slots 162 to hold the retainer 158 in place on the element 116. The retainer 158 defines a lip 166 which fits over the leading edge 186 of the insert 180 and holds it in place. A plurality of openings 168 are defined by the retainer 158 to allow saturant to flow from the channel 160 to the converging chamber 118 into the regions between the bands of the stencil 150. Thus, the retainer 158 both holds the leading edge 186 of the insert 180 in place and distributes saturant into the chamber 118.

The trailing edge 180 of the insert 180 defines an array of protruding fingers 192 and these fingers 192 are captured in place by respective openings 194 in a plate 196. The plate 196 is in turn removably secured to the element 116, as for example by screws 198.

The insert 180 acts as a seal by receiving the bands of the stencil 150 within the grooves 182. In effect, the insert 180 becomes a portion of one wall of the converging chamber 118, and this wall is contoured to receive the stencil 150. In this way, the raised areas 184 can be positioned as close to the web 140 as desired to obtain the necessary sealing action and to develop the desired pressure within the converging chamber 118. Of course. in alternate embodiments the grooves lB2 can actually be formed in the element 116, thereby eliminating the need for a separate insert. However, the insert 180 provides important advantages, in that it allows the element 116 to be readily adapted to differing stencils, simply by replacing the insert 180. If necessary, the retainer 158 can readily be removed and replaced as well.

Figure 7:
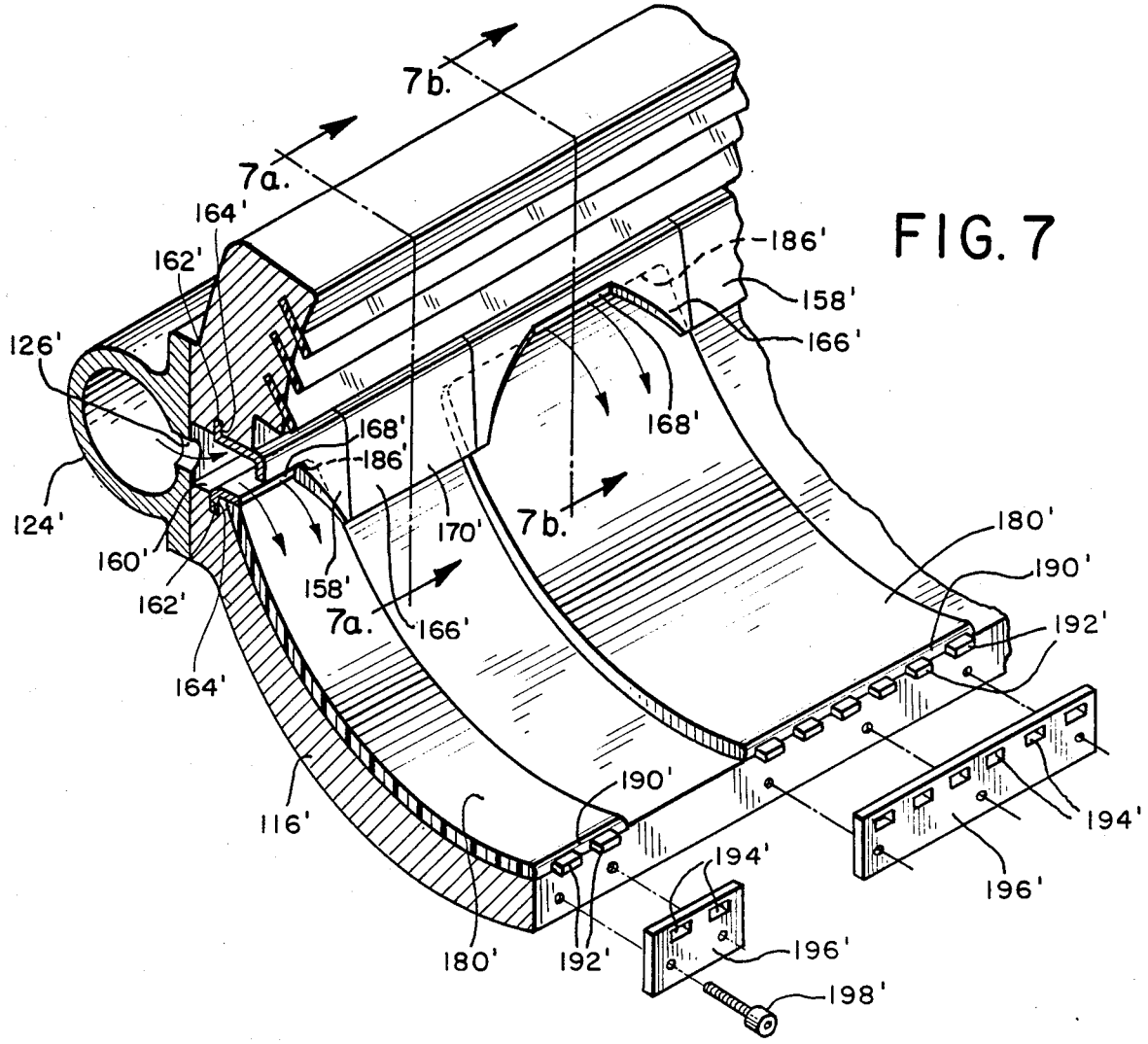
FIG. 7 is a fragmentary perspective view of portions of a variant of the embodiment of FIG. 4, which incorporates a third preferred embodiment of this invention.
Figure 7A:
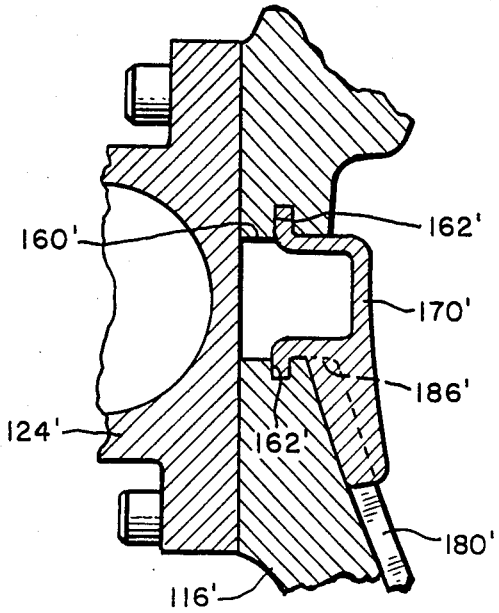
FIG. 7*a* is a sectional view taken along line 7*a*–7*a* of FIG. 7.
Figure 7B:
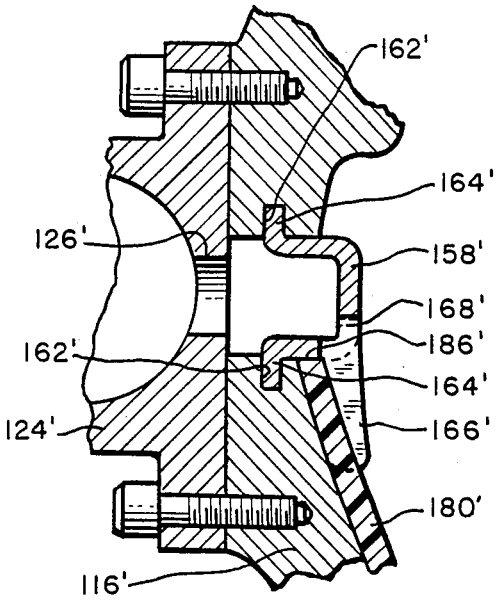
FIG. 7*b* is a sectional view taken along line 7*b*–7*b* of FIG. 7.

FIGS. 7, 7*a* and 7*b* relate to a third preferred embodiment which is similar to the embodiment of FIGS. 4–6. The key difference is that in the embodiment of FIGS. 7–7*b* the insert, retainer and plate are all formed of separate, modular components. In FIGS. 7–7*b* the same reference numerals are used as in FIGS. 4–6 for corresponding elements, except that the reference numerals of FIGS. 7–7*b* are primed. Except as indicated below, the second and third preferred embodiments are identical.

In the embodiment of FIGS. 7–7*b*, the insert 180' is composed of multiple parallel, spaced elements, each of which defines a respective leading and trailing edge 186', 190'. The leading edges 186' are held in place by retainers 158', and the trailing edges 190' are held in place by plates 196', all as described above in connection with FIGS. 5–6. The bands of the stencil (not shown) are sized and positioned to move between the inserts 180'. Thus, the inserts 180' of FIG. 7 correspond in function to the raised areas 184 of FIG. 5 and the regions between the inserts 180' of FIG. 7 correspond to the grooves 182 of FIG. 5. The retainers 158' are separated by spacers 170' which slide in the slots 162' and block the flow of saturant out of the channel 160' in the region between the retainers 158'.

The embodiment of FIGS. 7–7*b* is modular in construction, and it allows a small number of inserts 180', retainers 158', spacers 170' and plates 196' be combined as desired to accommodate a large variety of spacings and widths of the bands of the stencil. Preferably the inserts 180' are equal in width to the corresponding retainers 158' and plates 196'.

Figure 8:
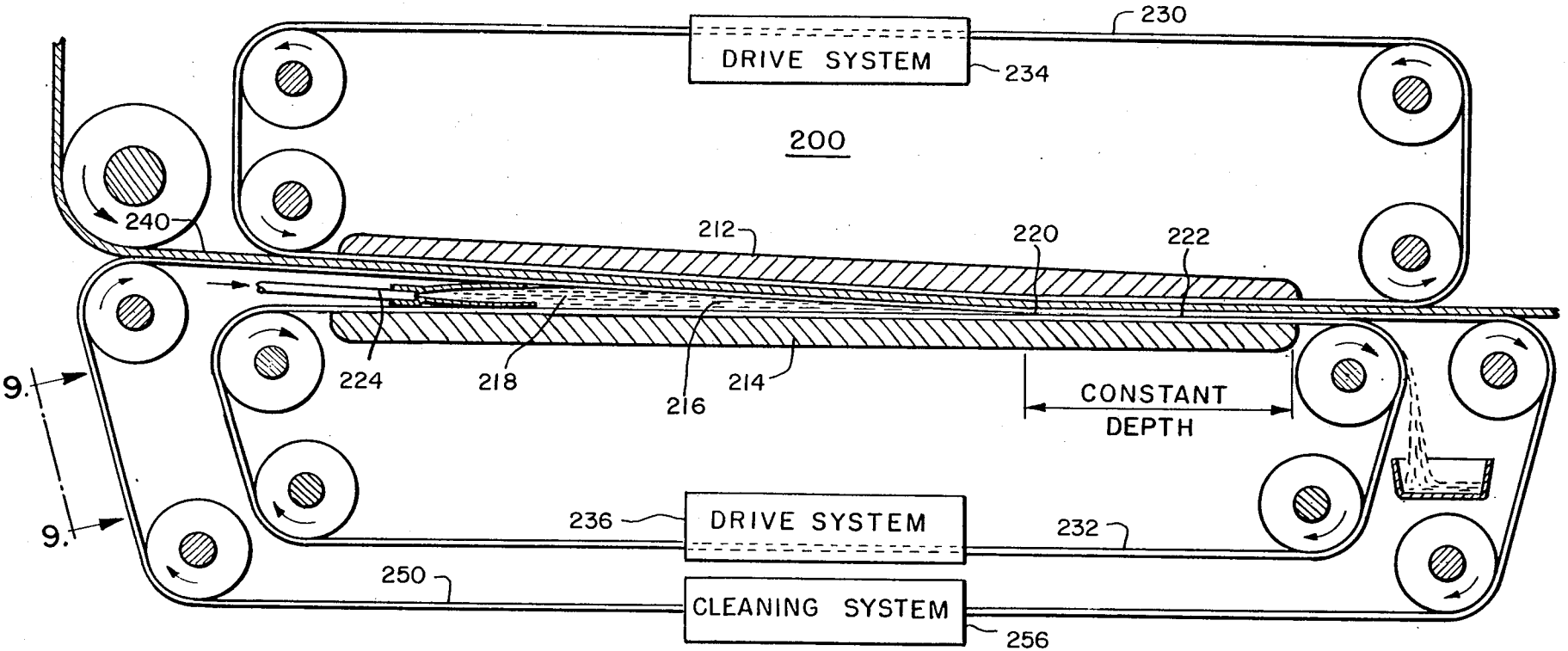
FIG. 8 is a cross-sectional view of a saturator which incorporates a fourth preferred embodiment of this invention.
Figure 9:
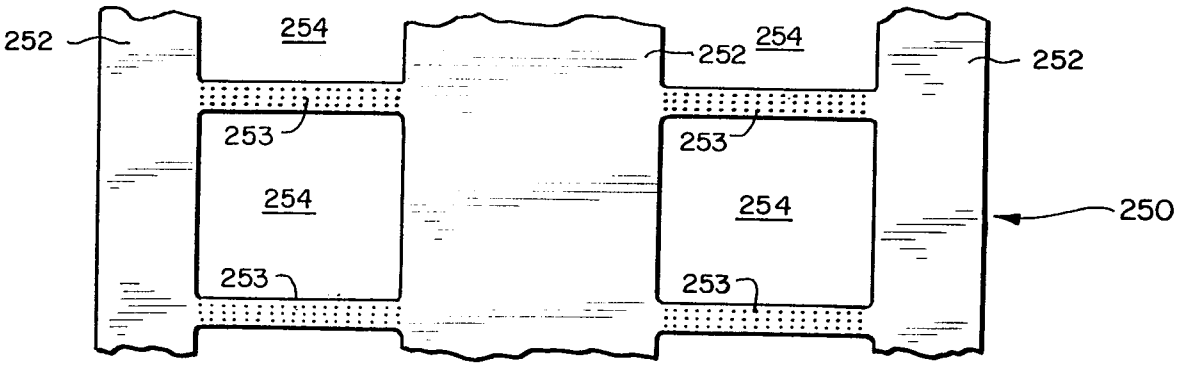
FIG. 9 is a fragmentary view taken along line 9—9 of FIG. 8.

FIGS. 8 and 9 relate to a fourth preferred embodiment 200 of this invention. This embodiment 200 differs significantly from the first, second, and third preferred embodiments in that neither of the two chamber defining elements 212,214 moves relative to the other in operation. Rather, each of the elements 212,214 is rigidly held in position by a frame (not shown). The two elements 212,214 define a converging chamber 216 therebetween. This converging chamber 216 includes a relatively deep entrance region 218 and a relatively shallow exit region 220. The elements 212,214 define an extended exit region 222 which provides an important sealing function as described below. Saturant is supplied to the converging chamber 216 via a supply port 224.

This fourth embodiment 200 includes upper and lower belts 230,232, each of which is rotated by a respective drive system 234,236 such that the two belts 232,234 move between the elements 212,214 at the same speed, thereby carrying the web 240 through the converging chamber 216. Preferably, these belts 230,232 are formed of an impermeable material such as stainless steel, and suitable lubricants are provided between the belts 230,232 and the chamber defining elements 212,214.

In addition, a closed loop stencil 250 is also passed through the converging chamber 216 positioned immediately adjacent to the web 240. This stencil 250 is moved at the same linear speed as the web 240, carried along by friction between the stencil 250 and the web 240. A stencil cleaning system 256 as described above is provided to remove saturant from the stencil 250.

As best shown in FIG. 9, in this embodiment the stencil 250 comprises a plurality of impermeable regions 252, each made up of a respective one of three parallel bands, and a plurality of permeable regions 254 positioned between the bands. In addition, the bands are interconnected by semi-permeable regions 253. In this embodiment, the semi-permeable regions 253 are formed of an impermeable sheet which defines a plurality of small openings. These openings allow some saturant to flow into the web 240. However, the flow of saturant into those portions of the web 240 aligned with the semi-permeable regions 253 is reduced as compared with the flow of saturant into those portions of the web 240 aligned with the permeable regions 254. Thus, the resulting saturated web 240 is devoid of saturant in certain portions aligned with the impermeable regions 252, is saturated to a greater extent in portions aligned with the permeable regions 254, and is saturated to a lesser extent in portions aligned with the semi-permeable regions 253. This can be of great advantage, for example, in conjunction with containers which are to have a high degree of saturation in the sidewalls, a low degree of saturation in the bend lines between adjacent sidewalls, and substantially no saturation in the end panels. The stencil 250 of FIG. 7 is suitable for such an application. The precise size and spacing of the openings of the semi-permeable regions 253 can be varied widely. However, in many cases it is preferable to have the openings sufficiently closely spaced such that the saturant is distributed across the entire portion of the web 240 aligned with the semi-permeable regions 253, rather than being localized into individual spots.

The extended exit 222 shown in FIG. 6 defines a chamber depth which is substantially equal to the sum of the thicknesses of the belts 230,232, the web 240, and the stencil 250. The length of the extended exit 222 along the direction of motion of the web 240 is preferably greater than the separation between two adjacent semi-permeable regions 253 along the direction of motion of the stencil 250. In this way, the pressure drop across a single one of the semi-permeable regions 253 is reduced, and the tendency to stretch the stencil 250 is reduced as well.

Of course, it should be understood that a wide range of changes and modifications can be made to the preferred embodiments described above. For example, it is not necessary in all embodiments that a converging chamber be used. Rather, a non-converging chamber of the type shown in Penley U.S. Pat. No. 2,711,032 is well suited for some applications. Furthermore, the particular geometry of the stencil can readily be adapted for the particular application. In the preferred embodiment described above, the stencil is formed of a sheet of stainless steel. However, other materials can be used as appropriate for the particular application.

It is therefore intended that the foregoing detailed description be regarded as illustrative rather than limiting, and that it be understood that it is the following claims, including all equivalents, which are intended to define the scope of this invention.

I claim:

1. In a saturator of the type comprising means for defining a chamber for containing a pressurized saturant therein and means for moving a web through the chamber to bring a first side of the web into contact with the pressurized saturant to cause the saturant to impregnate the web, the improvement comprising:

a stencil having at least one impermeable region shaped to cover less than the entire web; and means for passing the stencil through the chamber at the same speed as the web with the stencil juxtaposed against the first side of the web such that portions of the web aligned with the at least one impermeable region are not impregnated with the saturant while other, exposed portions of the web are impregnated with the saturant.

2. The invention of claim 1 wherein the stencil defines a closed loop.

3. The invention of claim 1 wherein the stencil comprises at least one band having a substantially constant width which is less than the width of the web.

4. The invention of claim 3 further comprising a seal plate positioned at one end of the chamber to restrict movement of saturant out of the chamber, said seal plate having a notched profile which defines at least one recess sized to receive the at least one band and at least one raised area sized to contact the web adjacent to the band.

5. The invention of claim 4 wherein the band defines a thickness, wherein the recess defines a depth, and wherein the depth of the recess is equal to the thickness of the band.

6. The invention of claim 3 wherein the band is aligned with a central portion of the web such that the central portion of the web is not impregnated with the saturant.

7. The invention of claim 1 wherein the web defines at least one central portion and at least one pair of lateral portions and wherein the stencil comprises a pair of spaced bands, each having a substantially constant width, wherein the bands are aligned with respective lateral portions of the web such that the lateral portions of the web are not impregnated with the saturant yet the central portion of the web is impregnated with the saturant.

8. The invention of claim 1 wherein the saturator comprises a rotating mandrel and an opposed chamber defining element, wherein the web is positioned adjacent to the mandrel as the web passes through the chamber, and wherein the stencil is positioned between the web and the chamber defining element as the stencil passes through the chamber.

9. The invention of claim 1 wherein the saturator chamber converges in depth gradually and progressively from an entrance region to an exit region, wherein the web passes from the entrance region to the exit region as it passes through the chamber, and wherein movement of the web through the chamber pressurizes the saturant in the chamber.

10. The invention of claim 1 wherein the impermeable region of the stencil comprises at least one band, and wherein the chamber defining means comprises a chamber wall which defines at least one groove sized to receive the at least one band, and at least one raised area adjacent to the groove.

11. The invention of claim 10 wherein at least a portion of the chamber wall is formed as an insert, and wherein the insert is removably mounted on a chamber defining element included in the chamber defining means.

12. The invention of claim 11 wherein the chamber defining means defines a saturant supply channel, and wherein the invention further comprises at least one retainer mounted to the chamber defining means over the channel, said retainer comprising means for controlling saturant flow out of the channel and means for securing one edge of the insert to the chamber defining element.

13. The invention of claim 12 wherein the securing means of the retainer comprises a lip positioned over the edge of the insert.

14. The invention of claim 11 wherein the insert defines an array of projections extending away from one edge thereof. and wherein the invention further comprises a plate removably mounted to the chamber defining means, said plate defining a plurality of openings sized to receive respective ones of the projections to secure the insert in place.

15. The invention of claim 1 wherein the impermeable region of the stencil comprises at least one band, and wherein the invention further comprises:

at least a pair of inserts; and means for mounting the inserts to a chamber defining element included in the chamber defining means such that the inserts are positioned on respective sides of the band in order to define a band receiving groove therebetween.

16. The invention of claim 15 wherein the chamber defining means defines a saturant supply channel, and wherein the mounting means comprises at least one pair of retainers mounted to the chamber defining means over the channel, said retainers each comprising means for directing saturant flow out of the channel and over a leading edge of the respective insert and a lip positioned over the leading edge of the respective insert.

17. The invention of claim 16 wherein each of the retainers is substantially equal in width to the respective insert.

18. The invention of claim 15 wherein each of the inserts defines an array of projections extending away from a trailing edge thereof, and wherein the mounting means comprises at least a pair of plates removably mounted to the chamber defining means, said plates each defining a plurality of openings sized to receive respective ones of the projections to secure the respective insert in place.

19. The invention of claim 18 wherein each of the plates is substantially equal in width to the respective insert.

20. The invention of claim 1 wherein the stencil further comprises at least one semi-permeable region which allows a reduced amount of the saturant to impregnate the corresponding portions of the web as compared with the exposed portions of the web.

21. The invention of claim 20 wherein the semipermeable region of the stencil defines a multiplicity of openings therein.

22. The invention of claim 21 wherein the impermeable region is arranged as a first band, and wherein the semi-permeable region is arranged as a second band, oriented transverse to the first band.

23. The invention of claim 1 wherein the chamber defines a relatively deep entrance region and a relatively shallow exit region;

wherein at least selected ones of the exposed portions of the web have a characteristic maximum length along the direction of travel of the web; and wherein the exit region comprises an extended exit region which is longer than the characteristic maximum length and which operates as a seal to reduce leakage of the saturant out of the chamber.

24. In a saturator of the type comprising a rotatable mandrel, a chamber defining element positioned adjacent to the mandrel to define a chamber therebetween, means for passing a web through the chamber, and means for supplying a saturant to the chamber, wherein the chamber tapers gradually from a relatively deep entrance region near where the web enters the chamber to a relatively shallow exit region near where the web leaves the chamber such that movement of the saturant through the chamber pressurizes the saturant in the chamber, the improvement comprising:

a closed loop stencil having at least one impermeable section shaped to cover less than the entire web;

means for passing the stencil through the chamber at the same speed as the web with the stencil situated adjacent the web between the web and the chamber defining element such that the impermeable section of the stencil prevents a correspondingly shaped portion of the web from contacting the saturant in the chamber, while other, exposed portions of the web are impregnated with the saturant.

25. The invention of claim 24 wherein the stencil comprises at least one band having a substantially constant width which is less than the width of the web.

26. The invention of claim 25 further comprising a seal plate positioned at one end of the chamber to restrict movement of saturant out of the chamber, said seal plate having a notched profile which defines at least one recess sized to receive the at least one band and at least one raised area sized to contact the web adjacent to the band.

27. The invention of claim 26 wherein the band defines a thickness, wherein the recess defines a depth, and wherein the depth of the recess is equal to the thickness of the band.

28. The invention of claim 25 wherein the band is aligned with a central portion of the web such that the central portion of the web is not impregnated with the saturant.

29. The invention of claim 24 wherein the web defines at least one central portion and at least one pair of lateral portions and wherein the stencil comprises a pair of spaced bands, each having a substantially constant width, wherein the bands are aligned with respective lateral portions of the web such that the lateral portions of the web are not impregnated with the saturant yet the central portion of the web is impregnated with the saturant.

30. The invention of claim 24 wherein the impermeable section of the stencil comprises at least one band, and wherein the chamber defining element defines a chamber wall having a groove formed therein sized to receive the band and at least one raised area adjacent to the groove.

31. The invention of claim 30 wherein the chamber defining element comprises an insert removably mounted thereon, wherein the groove and the raised area are formed on the insert.

32. The invention of claim 31 wherein the chamber defining element defines a saturant supply channel, and wherein the invention further comprises at least one retainer mounted to the chamber defining element over the channel, said retainer comprising means for controlling saturant flow out of the channel and means for securing one edge of the insert to the chamber defining element.

33. The invention of claim 32 wherein the securing means of the retainer comprises a lip positioned over the edge of the insert.

34. The invention of claim 31 wherein the insert defines an array of projections extending away from one edge thereof, and wherein the invention further comprises a plate removably mounted to the chamber defining means, said plate defining a plurality of openings sized to receive respective ones of the projections to secure the insert in place.

35. The invention of claim 24 wherein the impermeable section of the stencil comprises at least one band, and wherein the invention further comprises:

at least a pair of inserts; and means for mounting the inserts to the chamber defining element such that the inserts are positioned on respective sides of the band in order to define a band receiving groove therebetween.

36. The invention of claim 35 wherein the chamber defining element defines a saturant supply channel, and wherein the mounting means comprises at least one pair of retainers mounted to the chamber defining element over the channel, said retainers each comprising means for directing saturant flow out of the channel and over a leading edge of the respective insert and a lip positioned over the leading edge of the respective insert.

37. The invention of claim 36 wherein each of the retainers is substantially equal in width to the respective insert.

38. The invention of claim 35 wherein each of the inserts defines an array of projections extending away from a trailing edge thereof, and wherein the mount-means comprises at least a pair of plates removably mounted to the chamber defining element, said plates each defining a plurality of openings sized to receive respective ones of the projections to secure the respective insert in place.

39. The invention of claim 18 wherein each of the plates is substantially equal in width to the respective insert.

40. The invention of claim 30 wherein the groove gradually increases in depth to a maximum depth in the exit region of the chamber.

41. The invention of claim 24 wherein the stencil further comprises at least one semi-permeable region which allows a reduced amount of the saturant to impregnate the corresponding portions of the web as compared with the exposed portions of the web.

42. The invention of claim 41 wherein the semi-permeable region of the stencil defines a multiplicity of openings therein.

43. The invention of claim 41 wherein the impermeable region is arranged as a first band, and wherein the semi-permeable region is arranged as a second band, oriented transverse to the first band.

44. The invention of claim 24 wherein at least selected ones of the exposed portions of the web have a characteristic maximum length along the direction of travel of the web, and wherein the exit region comprises an extended exit region which is longer than the characteristic maximum length such that the extended exit region acts as a seal to reduce leakage of the saturant out of rhe chamber.

45. A method for selectively applying a saturant to only a patterned portion of a web with a saturator of the type comprising means for defining a chamber for containing a pressurized saturant therein and means for moving the web through the chamber to bring a first side of the web into contact with the pressurized saturant to cause the saturant to impregnate the web, said method comprising the following steps providing a stencil having at least one impermeable region shaped to cover less than the entire web; and passing the stencil through the chamber at the same speed as the web with the stencil juxtaposed against the first side of the web such that the portions or the web aligned with the at least one impermeable region are not impregnated with the saturant and other, exposed portions of the web are impregnated with the saturant.

46. The invention of claim 45 wherein the stencil defines a closed loop and wherein the passing step comprises the step of repeatedly cycling the stencil through the chamber.

47. The invention of claim 45 wherein the stencil comprises at least one band having a substantially constant width which is less than the width of the web and wherein the passing step forms at least one corresponding non-impregnated region of the web situated adjacent to at least one adjacent impregnated region of the web.

48. The invention of claim 47 wherein the nonimpregnated region of the web is situated in a central portion of the web.

49. The invention of claim 47 wherein the nonimpregnated region of the web is situated adjacent one edge ot the web.

50. The invention of claim 45 wherein the means for defining a chamber comprises a rotating mandrel and an opposed chamber defining element, wherein the web is positioned adjacent to the mandrel as the web passes througn the chamber, and wherein the stencil is positioned between the web and the chamber defining element in the passing step.

51. The invention of claim 45 wherein the chamber converges in depth gradually and progressively from an entrance region to an exit region, wherein the web passes rrom the entrance region to the exit region as it passes through the chamber, and wherein movement of the web through the chamber pressurizes the saturant in the chamber.

52. The invention of claim 45 wherein the stencil further comprises at least one semi-permeable region, and whereein a reduced amount of the saturant impregnates the corresponding portions of the web as compared with the exposed portions of the web during the passing step.

53. The invention of claim 52 wherein the semipermeable region of the stencil defines a multiplicity of openings therein.

54. The invention of claim 45 wherein the means for defining a chamber comprises a chamber wall which defines a groove sized to receive at least a portion of the stencil.

55. A method for selectively applying a saturant to only a patterned portion of a web with a saturator of the type comprising: a rotatable mandrel, a chamber defining element positioned adjacent to the mandrel to define a chamber therebetween, means for passing a web through the chamber, and means for supplying a saturant to the chamber, wherein the chamber tapers gradually from a selatively deep entrance region near where the web enters the chamber to a relatively shallow exit region near where the web leaves the chamber such that movement of the web through the chamber pressurizes the saturant in the chamber, said method comprising the following steps:

providing a closed loop stencil having at least one impermeable section shaped to cover less than the entire web;

repeatedly cycling the stencil through the chamber at the same speed as the web with the stencil situated adjacent the web between the web and the chamber defining element such that the impermeable section of the stencil prevents a correspondingly shaped portion of the web from contacting the saturant in the chamber, while other, exposed portions of the web are impregnated with the saturant.

56. The invention of claim 55 wherein the stencil comprises at least one band having a substantially constant width which is less than the width of the web and wherein the passing step forms at least one corresponding nonimpregnated region of the web situated adjacent to at least one impregnated region of the web.

57. The invention of claim 56 wherein the nonimpregnated region of the web is situated in a central portion of the web.

58. The invention of claim 56 wherein the nonimpregnated region of the web is situated adjacent one edge of the web.

59. The invention of claim 55 wherein the stencil further comprises at least one semi-permeable region, and wherein a reduced amount of the saturant impregnates portions of the web aligned with the semi-permeable region as compared with the exposed portions of the web during the cycling step.

60. The invention of claim 59 wherein the semipermeable region of the stencil defines a multiplicity of openings therein.

61. The invention of claim 55 wherein the chamber defining element defines a groove sized to receive at least a portion of the stencil.

* * * * *